US006401339B1

(12) United States Patent
Schmidt et al.

(10) Patent No.: US 6,401,339 B1
(45) Date of Patent: Jun. 11, 2002

(54) APPARATUS FOR CUTTING A COIN ROLL WRAPPER

(75) Inventors: G. Gerry Schmidt, Newport Beach, CA (US); Dale E. Jennings, 16644 Redwood St., Fountain Valley, CA (US) 92708

(73) Assignee: Dale E. Jennings, Fountain Valley, CA (US)

( * ) Notice: Subject to any disclaimer, the term of this patent is extended or adjusted under 35 U.S.C. 154(b) by 0 days.

(21) Appl. No.: 09/415,908

(22) Filed: Oct. 10, 1999

Related U.S. Application Data

(63) Continuation of application No. 08/980,810, filed on Dec. 10, 1997, now Pat. No. 5,964,388.

(51) Int. Cl.[7] ..... B27B 27/00

(52) U.S. Cl. ..... 30/2; 30/90.4; 30/289; 30/278

(58) Field of Search ..... 30/2, 90.4, 289, 30/278, 286, 293, 294, 280, 92.5, 272.1, 314, 112, 334, 335, 336, 337; 83/582, 597, 698.31, 946, DIG. 1, 588, 698.11, 856, 440, 438, 440.2, 441, 924

(56) References Cited

U.S. PATENT DOCUMENTS

| | | | | | |
|---|---|---|---|---|---|
| 1,959,378 | A | | 5/1934 | Magill | 30/3 |
| 2,050,768 | A | | 8/1936 | Seymour | 30/3 |
| 2,329,805 | A | | 9/1943 | Wilson | 30/91 |
| 2,835,031 | A | | 5/1958 | Cook | 30/91 |
| 3,043,004 | A | | 7/1962 | Walter | 30/91 |
| 3,781,987 | A | * | 1/1974 | Gentscheff | 30/2 |
| 4,001,934 | A | | 1/1977 | Bell | 30/124 |
| 4,106,196 | A | | 8/1978 | Smithline | 30/294 |
| 4,333,234 | A | | 6/1982 | Smith et al. | 30/2 |
| 4,382,330 | A | | 5/1983 | Harbaugh | 30/124 |
| 4,757,611 | A | | 7/1988 | Tommi et al. | 30/2 |
| 4,825,738 | A | | 5/1989 | Jones | 83/56 |
| 4,852,253 | A | | 8/1989 | Uchida | 30/2 |
| 5,123,320 | A | | 6/1992 | Hochfeld | 83/856 |
| 5,377,410 | A | * | 1/1995 | Welch | 30/90.1 |
| 5,561,903 | A | | 10/1996 | Bourbeau | 30/90.4 |
| 5,659,963 | A | | 8/1997 | McCrady | 30/307 |
| 5,822,863 | A | * | 10/1998 | Ott | 30/90.4 |
| 5,964,388 | A | * | 10/1999 | Jennings et al. | 225/2 |
| 5,974,668 | A | * | 11/1999 | Butzer | 30/112 |
| 5,992,286 | A | * | 11/1999 | Boole | 83/856 |

FOREIGN PATENT DOCUMENTS

| | | |
|---|---|---|
| GB | 313782 | 6/1929 |

* cited by examiner

*Primary Examiner*—Boyer Ashley
(74) *Attorney, Agent, or Firm*—Henricks, Slavin & Holmes LLP

(57) ABSTRACT

An apparatus for cutting a coin roll wrapper includes a housing, a front cover, a blade spring assembly and a safety spring. The housing includes a top opening and a bottom opening, both of which are sized to receive a roll of coins therethrough. A preferred blade spring assembly includes a cutting blade and a leaf spring which mechanically couples the cutting blade to the front cover. An end portion of the leaf spring is positioned between the cutting blade and the bottom opening. A preferred safety spring comprises a second leaf spring which is secured to the front cover between the top opening and the spring blade assembly. In a preferred embodiment, the safety spring and the blade spring are configured to allow a roll of coins to pass through the housing entering from the top opening and exiting from the bottom opening, but not vice versa. In a preferred embodiment, the safety spring and the blade spring are also configured to center the roll of coins relative to the cutting blade.

1 Claim, 10 Drawing Sheets

100
102
108
110
112
116
118
124
126
128
130
132
133
134
214

104
196
188
190
212
180
182
202
210
194
200
206
184
192
186
204
208
134

108
112
220
222
224
226
228
230
232
234
236
237
238
240
242
244
246
248
250
252

APPARATUS FOR CUTTING A COIN ROLL WRAPPER

CROSS-REFERENCE TO RELATED APPLICATIONS

This application is a continuation-in-part of U.S. patent application Ser. No. 08/980,810 entitled "Coin Roll Wrapper Cutter" filed on Dec. 10, 1997, now U.S. Pat. No. 5,964,388.

BACKGROUND OF THE INVENTION

1. Field of Invention

The present invention relates generally to an apparatus for cutting a coin roll wrapper and, more specifically, to an apparatus which includes a spring-biased blade and a safety spring secured within a housing.

2. Description of the Related Art

A variety of cutting devices for coin roll wrappers exist. Many of these devices, however, include a cutting blade or edge which is exposed and/or easily brought into contact with the fingers of the user. As a result, prior cutting devices often present a danger to the user who could accidentally bring a finger, hand, etc. into contact with the cutting blade. Thus, a need exists for a coin roll wrapper cutter which is particularly designed to address the aforementioned safety issue.

Another problem with prior cutting devices is that many of them are not well suited for cutting the wrappers of coin rolls that have different diameters. For example, prior cutting devices often fail to properly center the roll of coins relative to the cutting blade, or fail to position the roll of coins sufficiently close to the cutting blade. Thus, a need exists for a coin roll wrapper cutter which is suitable for coin rolls that have different diameters and which ensures proper positioning of the coin rolls relative to the cutting blade.

An additional problem with prior cutting devices is that they are often overly complex, bulky, expensive and/or difficult to assembly. Thus, a need exists for a coin roll wrapper cutter which addresses some or all of the aforementioned problems.

SUMMARY OF THE INVENTION

According to an exemplary preferred embodiment of the present invention, an apparatus for cutting a coin roll wrapper includes a housing, a front cover, a blade spring assembly and a safety spring. The housing includes a top opening and a bottom opening, both of which are sized to receive a roll of coins therethrough. In a preferred embodiment, the blade spring assembly is positioned toward the bottom opening to lessen the chances that a user of the apparatus will be able to reach into the housing through the top opening and touch the blade assembly. An exemplary preferred blade spring assembly includes a cutting blade and a leaf spring with an end portion. The leaf spring mechanically couples the cutting blade to the front cover. The end portion of the leaf spring is positioned between the cutting blade and the bottom opening, thereby lessening the chances that the user of the apparatus will be able to reach into the housing through the bottom opening and touch the cutting blade. Additionally, the leaf spring flexes away from the bottom opening when its end portion is contacted by the user through the bottom opening. This further lessens the chances that the user will be able to inadvertently come in contact with the cutting blade.

The safety spring embodies yet another design feature directed toward lessening the chances that the user will inadvertently come into contact with the cutting blade. To this end, an exemplary preferred safety spring comprises a second leaf spring which is secured to the front cover between the top opening and the spring blade assembly. The safety spring serves a variety of purposes. First, the safety spring serves as a barrier to further lessen the chances that the user will be able to reach into the housing through the top opening and inadvertently contact the cutting blade. Second, the safety spring serves as a one-way "mechanical valve" to the extent that it allows a roll of coins to pass through the housing entering through the top opening and exiting through the bottom opening, but prevents a roll of coins which has been advanced into the housing through the top opening and past the safety spring from being pushed back out of the housing through the top opening. Furthermore, the bottom portion of the exemplary preferred spring blade assembly also serves as a one-way "mechanical valve" to the extent that it blocks a roll of coins entering into the housing through the bottom opening from advancing through the housing, but allows a roll of coins entering into the housing through the top opening to pass through the housing and exit through the bottom opening.

The safety spring and the blade spring serve still another function, namely, the centering of the roll of coins relative to the cutting blade as the roll of coins is advanced through the housing. More specifically, the springs are formed with symmetrical guide members such as flanges which accommodate coin rolls with different diameters and which ensure proper positioning of the coin rolls relative to the cutting blade.

The front cover includes an inside surface and is secured to a front portion of the housing. The safety spring and the blade spring each include a base portion which is secured to the inside surface of the front cover resulting in a low-profile, streamlined apparatus for cutting coin roll wrappers which is easy to assembly and takes up very little work space.

In another exemplary preferred embodiment, an apparatus for cutting a coin roll wrapper includes: a housing with a top opening and a bottom opening which are sufficiently large to receive a roll of coins in a wrapper; a blade with a cutting edge, the blade being secured within the housing such that the cutting edge makes a longitudinal cut along the wrapper as the roll of coins is advanced through the housing, entering through the top opening and exiting through the bottom opening; and a valve mechanism secured within the housing, the valve mechanism allowing the roll of coins to advance through the housing from the top opening to the bottom opening, but preventing the roll of coins from passing through the housing from the bottom opening to the top opening.

In another exemplary preferred embodiment, an apparatus for cutting a coin roll wrapper includes: a housing with a top opening and a bottom opening which are sufficiently large to receive a roll of coins in a wrapper; and a cutting assembly secured within the housing, the cutting assembly including a blade with a cutting edge, and a spring mechanically coupling the blade to the housing such that the cutting edge makes a longitudinal cut along the wrapper as the roll of coins is advanced through the housing, entering through the top opening and exiting through the bottom opening.

In another exemplary preferred embodiment, an apparatus for cutting a coin roll wrapper includes: a housing with a top opening and a bottom opening which are sufficiently large to receive a roll of coins in a wrapper, the housing including a front portion with at least one opening; a front cover secured to the front portion, the front cover including an inside surface; and a blade assembly with a cutting edge, the blade assembly being secured to the inside surface such that the blade assembly projects into the housing through the at least one opening and the cutting edge makes a longitudinal cut along the wrapper as the roll of coins is advanced through the housing, entering through the top opening and exiting through the bottom opening.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the inventions will be made with reference to the accompanying drawings.

FIG. 8 is a cross-sectional view of the apparatus of

FIG. 6 along line 8—8;

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention.

This application is a continuation-in-part of U.S. patent application Ser. No. 08/980,810 entitled "Coin Roll Wrapper Cutter" filed on Dec. 10, 1997, the disclosure of which is incorporated herein by reference in its entirety.

Figure 1:
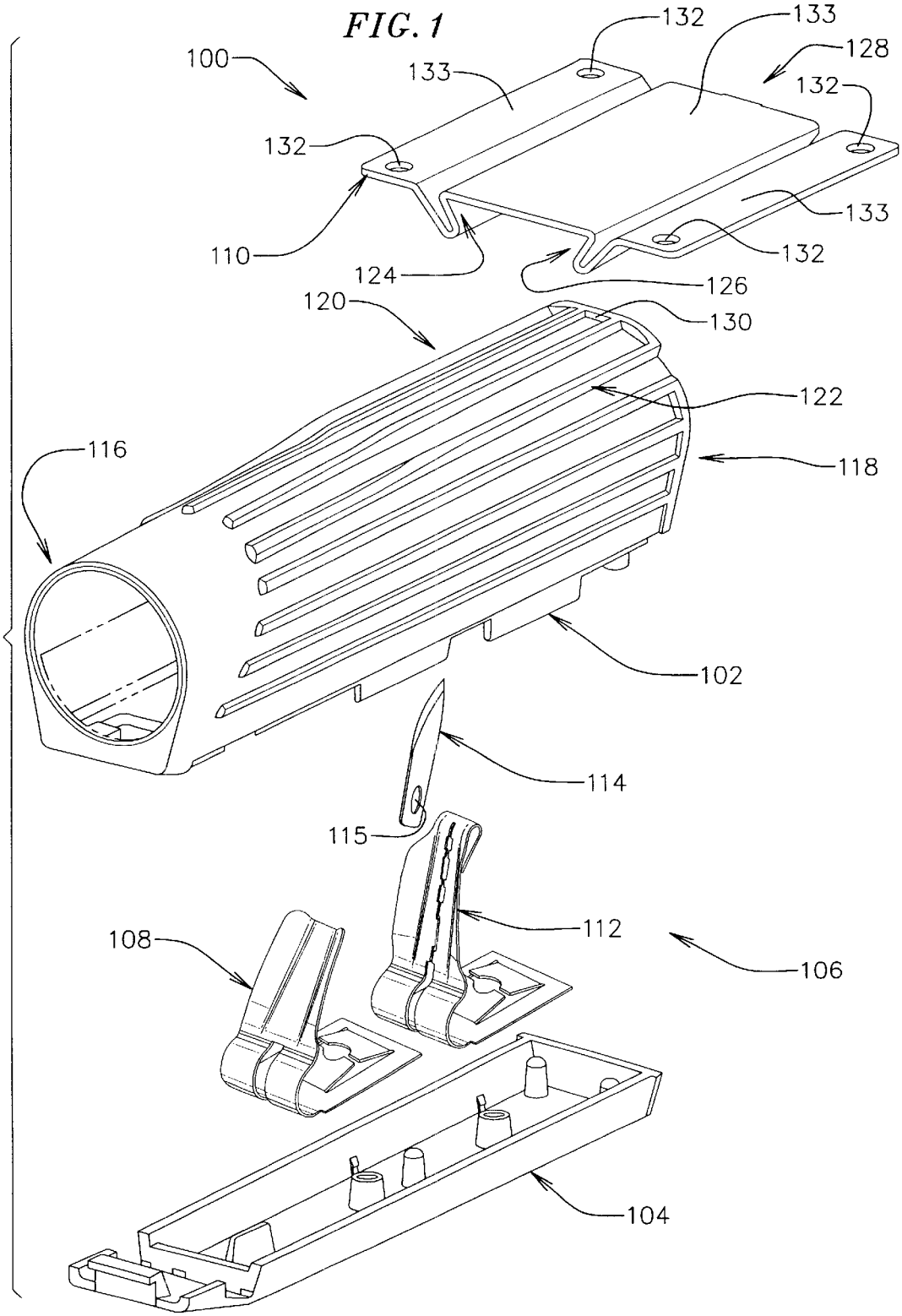
FIG. 1 is an exploded perspective view of an exemplary preferred embodiment of an apparatus for cutting a coin roll wrapper according to the present invention.
Figures 2, 3A, 3B, 3C, 3D:
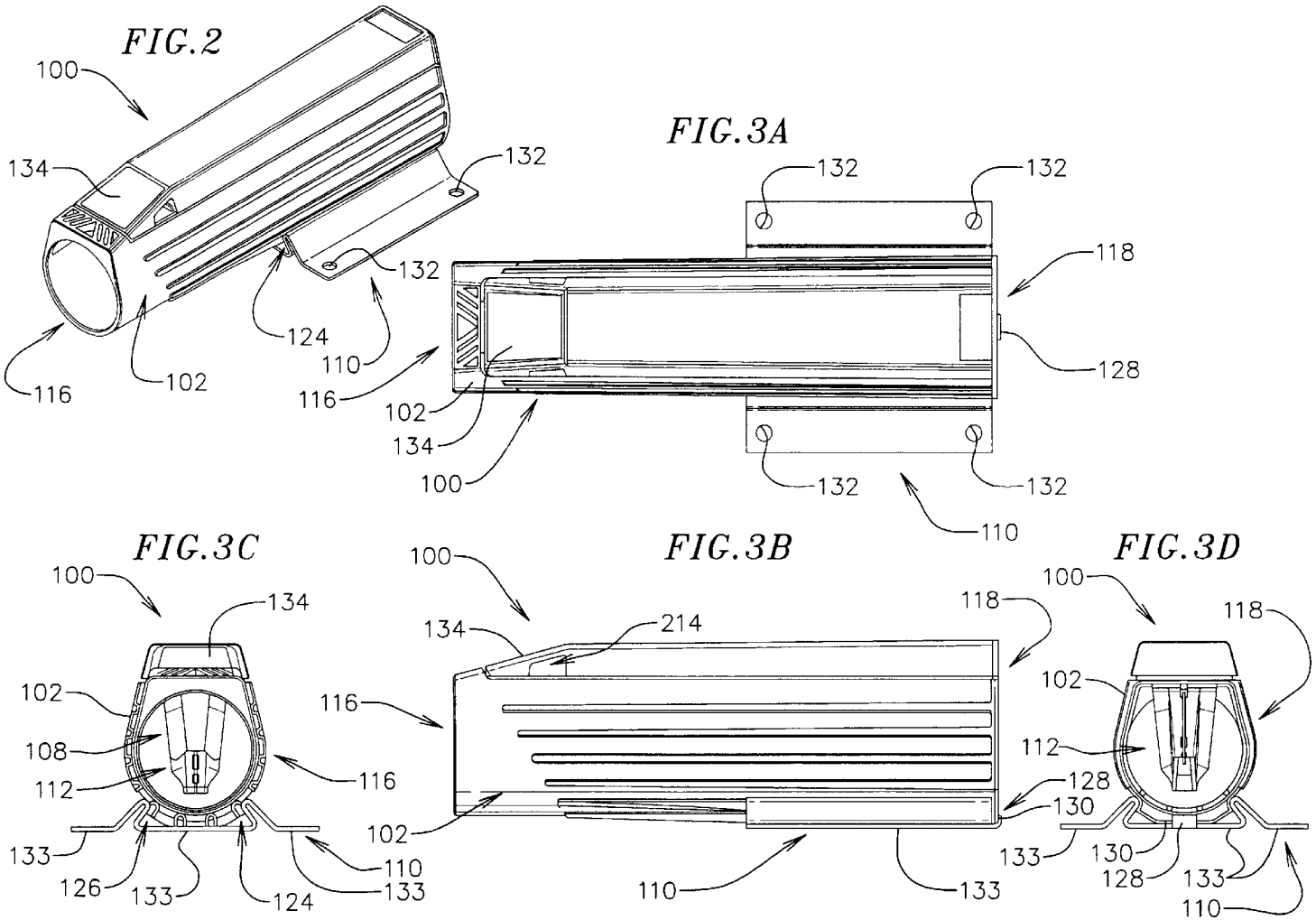
FIG. 2 is a perspective view of the apparatus of FIG. 1.
FIGS. 3A–3D are front, side, top end and bottom end views, respectively, of the apparatus of FIG. 2.
Figure 5:
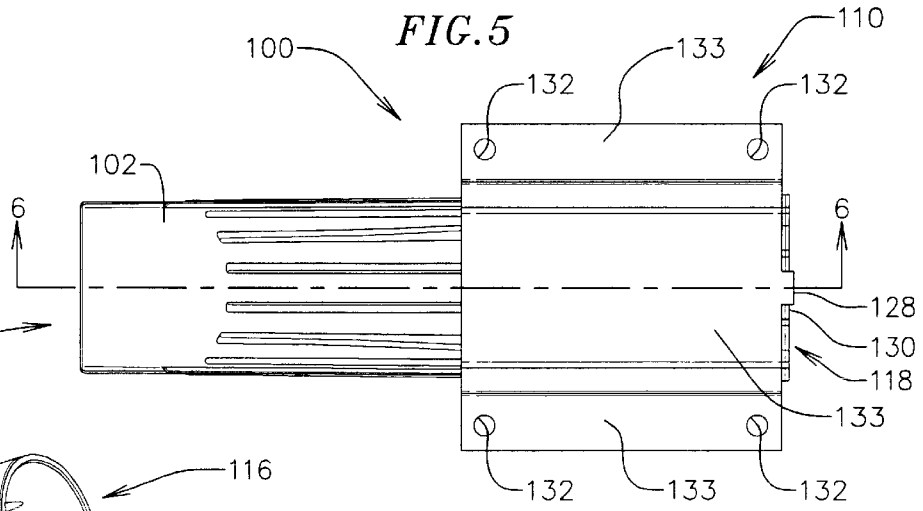
FIG. 5 is a back view of the apparatus of FIG. 4.
Figure 6:
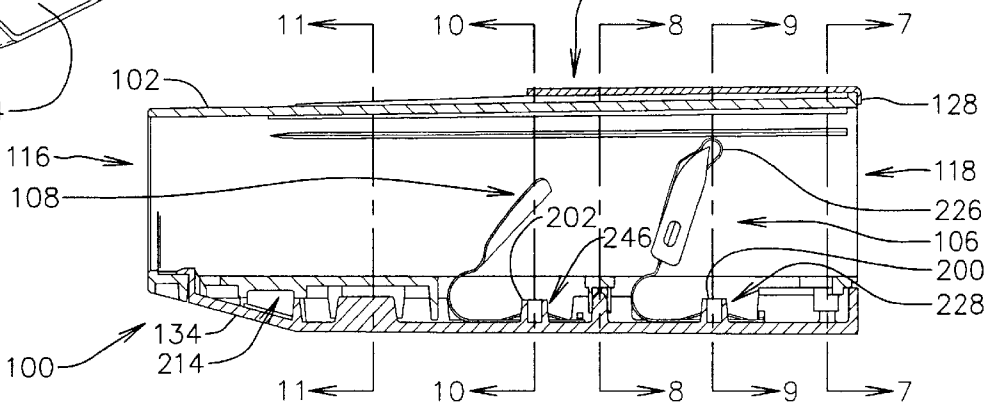
FIG. 6 is a cross-sectional side view of the apparatus of FIG. 5 along line 6—6.
Figure 4:
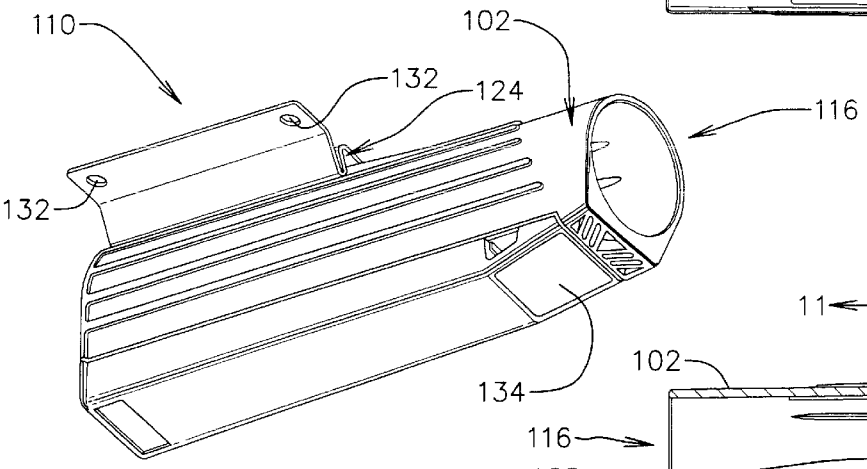
FIG. 4 is another perspective view of the apparatus of FIG. 1.
Figure 9:
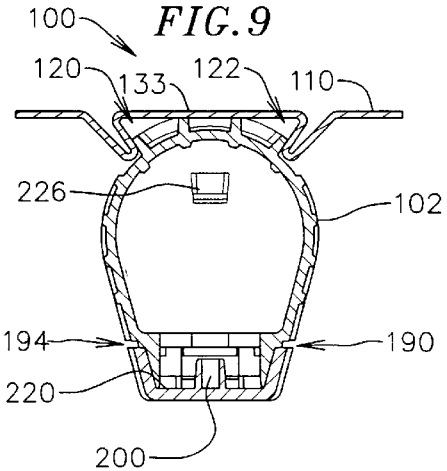
FIG. 9 is a cross-sectional view of the apparatus of FIG. 6 along line 9—9.
Figure 8:
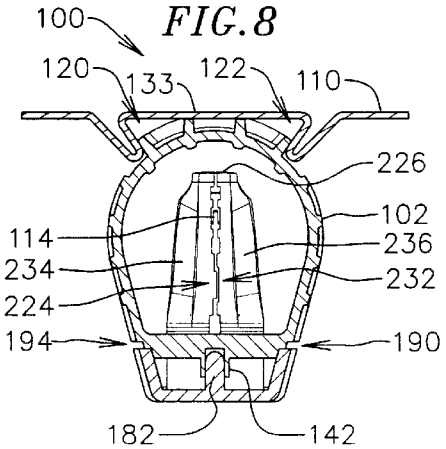
Figure 7:
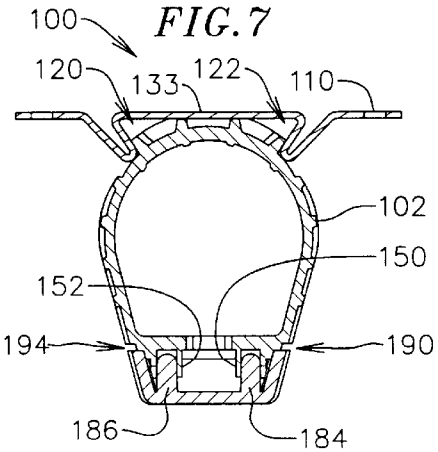
FIG. 7 is a cross-sectional view of the apparatus of FIG. 6 along line 7—7.
Figure 11:
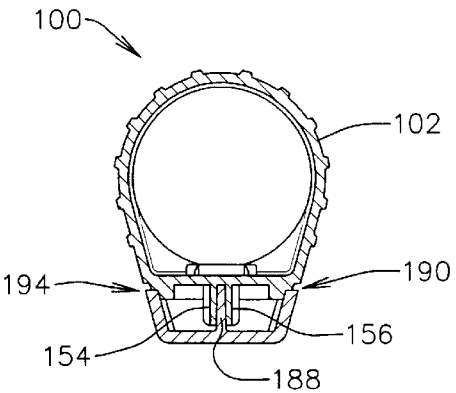
FIG. 11 is a cross-sectional view of the apparatus of FIG. 6 along fine 11—11.
Figure 10:
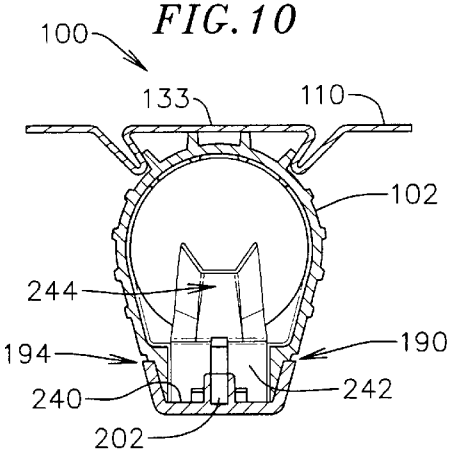
FIG. 10 is a cross-sectional view of the apparatus of FIG. 6 along line 10—10.

Referring to FIG. 1, an exemplary preferred coin roll wrapper cutter apparatus 100 according to the present invention includes a housing 102, a front cover or panel 104, a blade spring assembly 106, a safety spring 108 and a bracket or holder 110. An exemplary preferred blade spring assembly 106, in turn, includes a blade spring 112 and a cutting blade 114 formed as shown with a curved cutting edge.

An exemplary preferred housing 102 is generally tube-shaped and includes a top opening 116 and a bottom opening 118 which are both sufficiently large to receive a roll of coins, e.g. a roll of quarters. An exemplary preferred top opening 116 is preferably, but not necessarily, circular in shape. An exemplary preferred bottom opening 118 is generally circular in shape as well. With regard to materials, the housing 102 is preferably formed from plastic, but can be made from other materials.

Referring to FIGS. 1–6, the exemplary preferred housing 102 is formed with mounting surfaces 120 and 122 which are shaped to be mechanically coupled with complementary surfaces 124 and 126 of the bracket 110. The mounting surfaces 120 and 122 comprise, for example, longitudinal ridges formed along the length of the housing 102 as shown. An exemplary preferred bracket 110 includes a supporting flange 128 which contacts and supports a bottom edge 130 of the housing 102 when the mounting surfaces 120 and 122 are mechanically coupled to the complementary surfaces 124 and 126. The illustrated bracket 110 also includes apertures 132 sized to receive conventional screws or the like for mounting the bracket 110 to a surface, for example, near a cashier's work area. Also, the bracket 110 preferably includes at least one flat or substantially flat back portion 133 for securing the bracket 110 to an object with double-sided adhesive tape or the like. Preferably, the bracket 110 is mounted such that the supporting flange 128 is on the edge of the bracket facing downward. With the bracket 110 so oriented, the housing 102 is slid downward into the bracket 110 with the top opening 116 facing upward. This allows the cashier to advance a roll of coins into the top opening 116 with the assistance of gravity. With regard to materials, an exemplary preferred bracket 110 is formed from metal or plastic, but can be made from other materials.

An exemplary preferred front cover 104 includes an outside surface 134 for instructions, advertisements, etc. positioned adjacent the top opening 116. The outside surface 134 is formed with, or suitable for the application of, visible indicia (not shown) such as the text, "INSERT COIN ROLLS HERE". Other messages and/or symbols can be displayed at the outside surface 134. Alternatively or additionally, other external portions of the apparatus 100 can be used to display visible indicia.

Figure 13A:
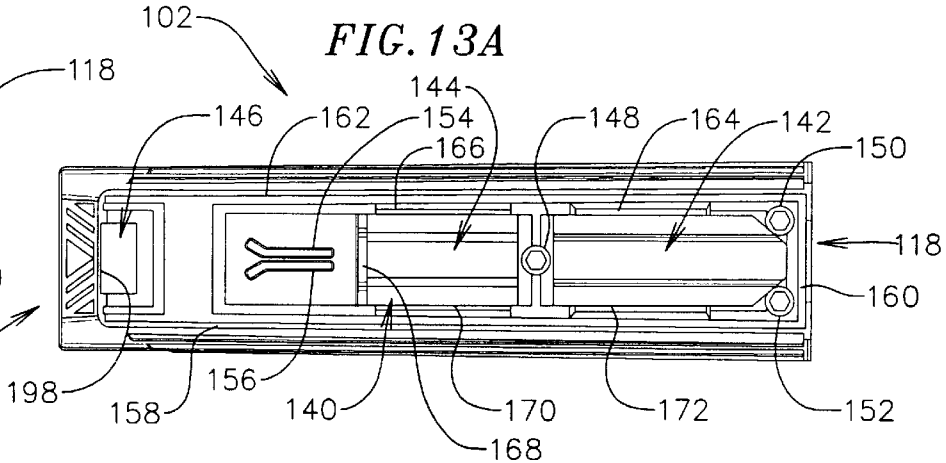
FIGS. 13A–13C are front, side and top end views, respectively, of the housing of FIG. 12.
Figure 13B:
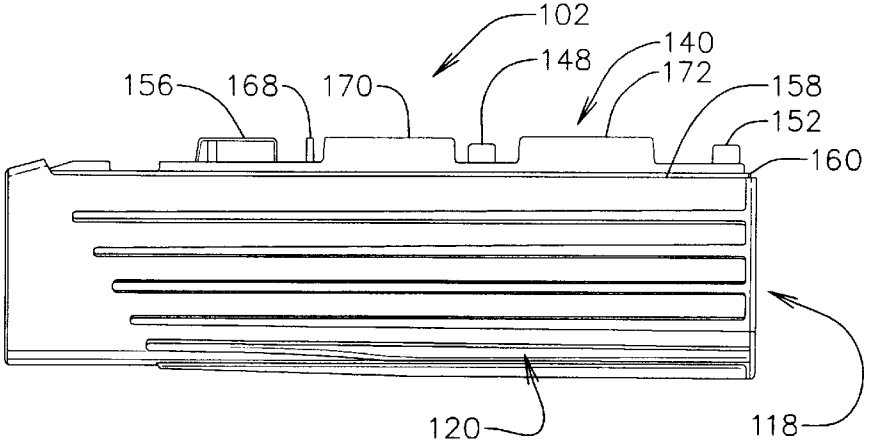
Figure 12:
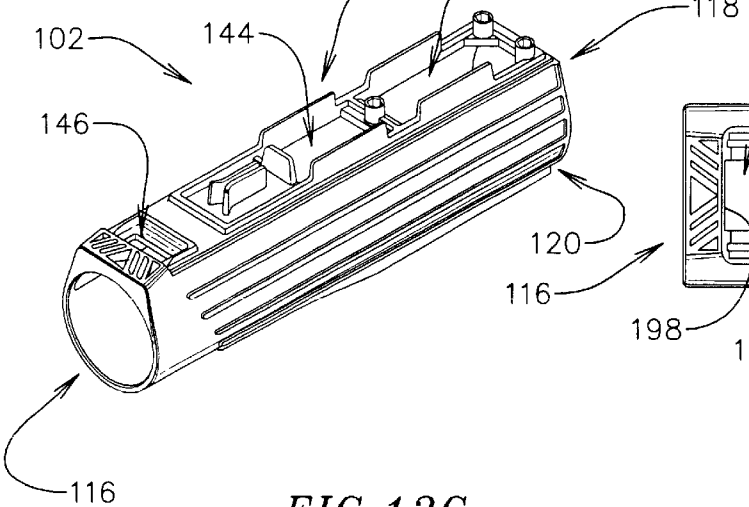
FIG. 12 is a perspective view of the housing of the apparatus shown in FIG. 1.
Figure 13C:
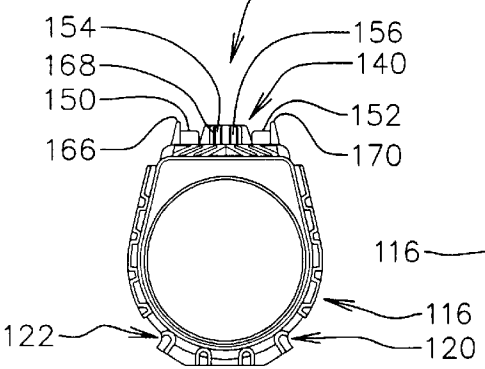
Figure 14:
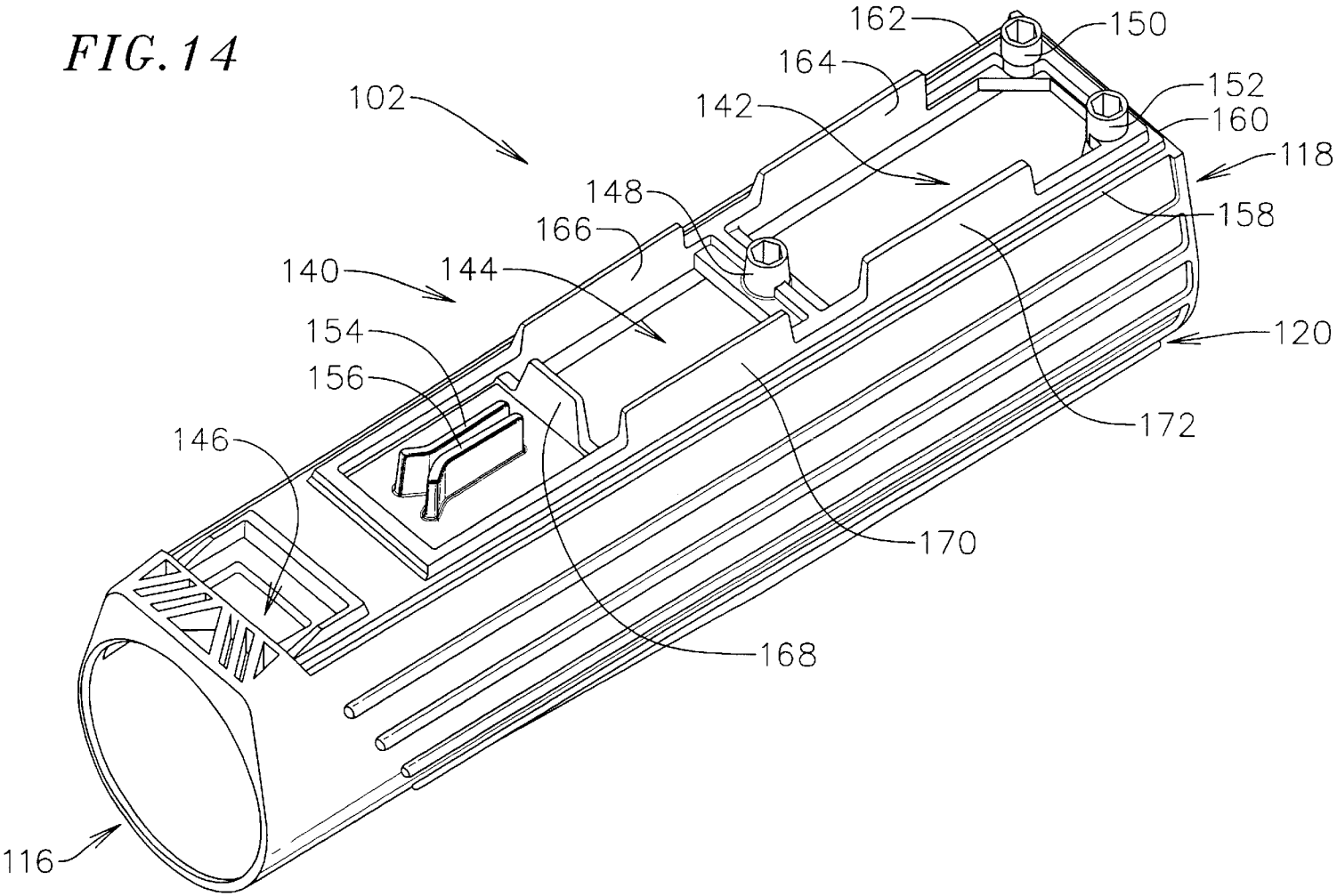
FIG. 14 is an enlarged perspective view of the housing of the apparatus shown in FIG. 1.

Referring to FIGS. 12–14, an exemplary preferred housing 102 includes a front portion 140 with at least one opening. An exemplary preferred front portion 140 includes a first opening 142, a second opening 144 and a third opening 146 formed as shown. The front portion 140 also includes socket members 148, 150 and 152, ridges 154 and 156, indented edges 158, 160 and 162, and fins 164, 166, 168, 170 and 172 formed as shown.

Figures 15, 16A, 16B:
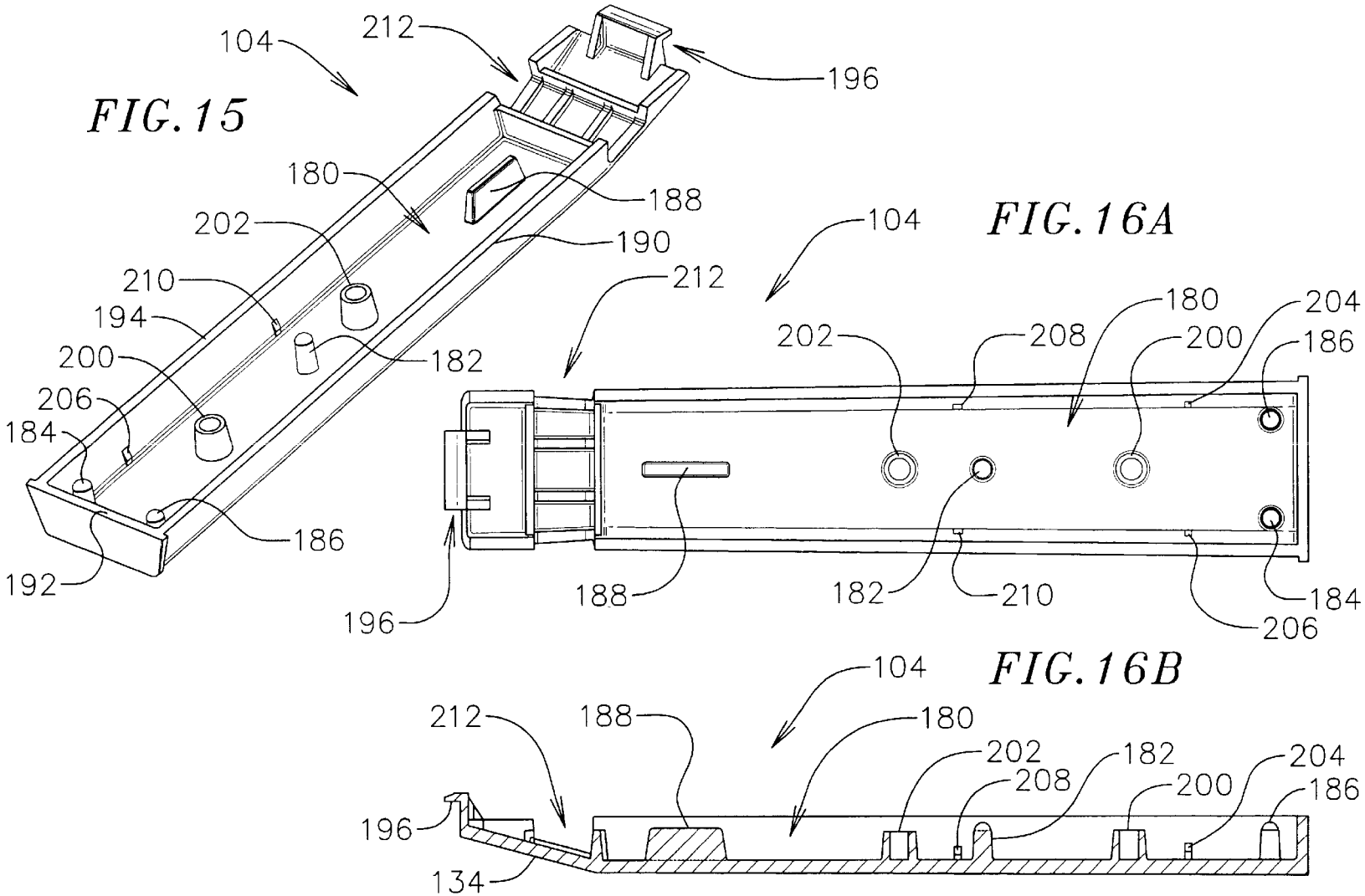
FIG. 15 is a perspective view of the cover of the apparatus shown in FIG. 1.
FIGS. 16A and 16B are back and cross-sectional side views, respectively, of the cover of FIG. 15.

Referring to FIGS. 15–16B, an exemplary preferred front cover 104 includes an inside surface 180 with socket posts 182, 184 and 186, a ridge 188, and perimeter walls 190, 192 and 194 formed as shown. When the front cover 104 is positioned over the front portion 140 of the housing 102: the socket members 148, 150 and 152 receive the socket posts 182, 184 and 186, respectively; the ridges 154 and 156 are positioned on either side of the ridge 188; and the perimeter walls 190, 192 and 194 are seated on the indented edges 158, 160 and 162, respectively. The exemplary preferred front cover 104 also includes a latching surface 196 formed as shown which fits under a complementary surface 198 (FIG. 13A) inside the third opening 146 of the housing 102. In an exemplary preferred embodiment, a conventional adhesive or glue is employed to secure the front cover 104 to the housing 102. Alternatively, the housing 102 and the front cover 104 can be modified so that they are secured to each other without an adhesive or glue, e.g., snap fitted together.

An exemplary preferred inside surface 180 of the front cover 104 also includes a first spring post 200, a second spring post 202, and ridges 204, 206, 208 and 210 formed and positioned as shown. The exemplary preferred front cover 104 also includes a recessed portion 212 formed behind the surface 134. When the housing 102 and the front cover 104 are secured together, the housing 102 and the recessed portion 212 of the front cover 104 define a lanyard 214 (e.g., FIG. 6) which accommodates a string, cord or the like for securing the coin roll wrapper cutter apparatus 100 to an area such as a work place.

Figures 17, 18A, 18B, 18C, 19, 20A, 20B, 20C:
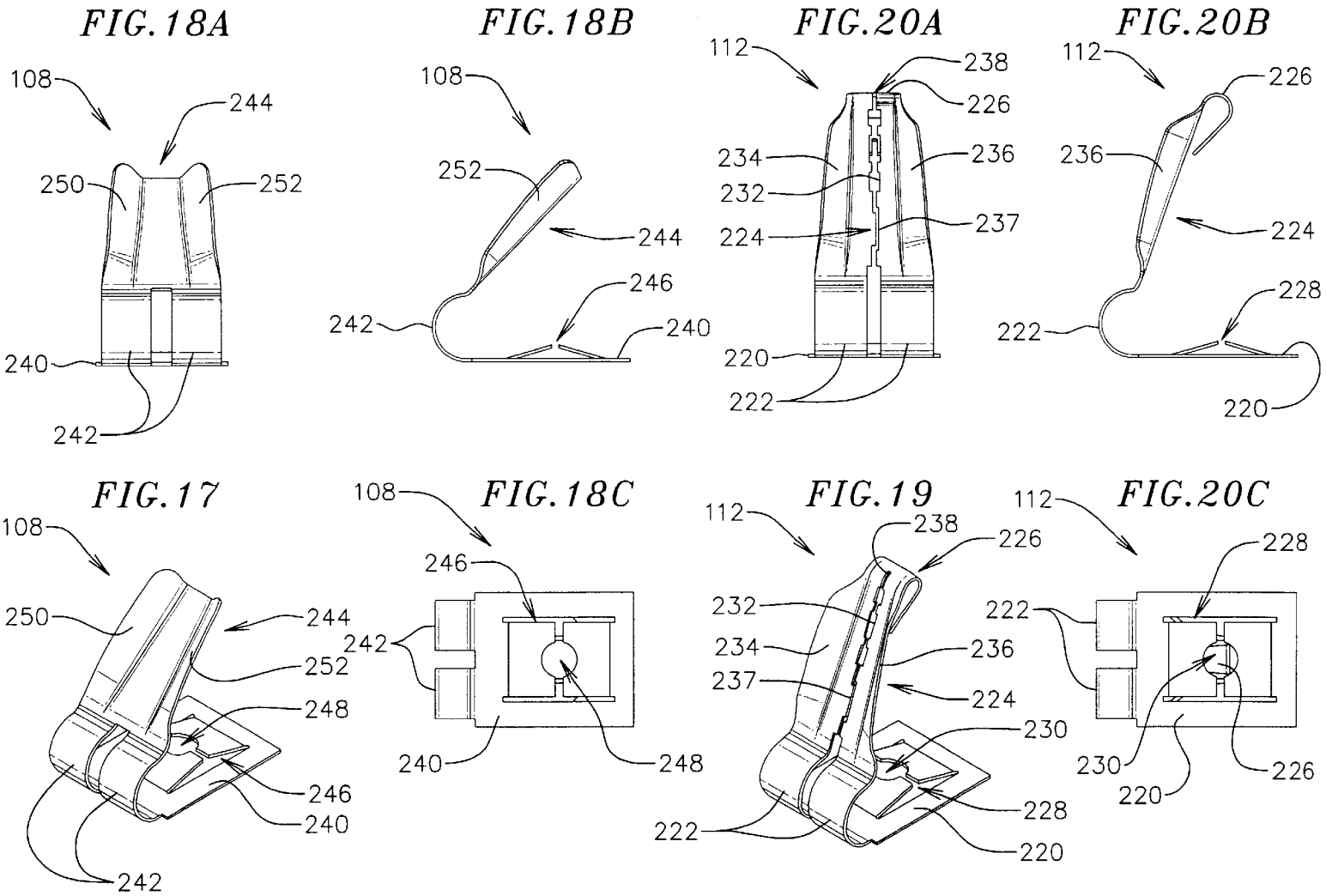
FIG. 17 is a perspective view of the safety spring of the apparatus shown in FIG. 1.
FIGS. 18A–18C are front, side and bottom views, respectively, of the safety spring of FIG. 17.
FIG. 19 is a perspective view of the blade spring assembly of the apparatus shown in FIG. 1.
FIGS. 20A–20C are front, side and bottom views, respectively, of the blade spring assembly of FIG. 19.

Referring to FIGS. 19–20C, an exemplary preferred blade spring 112 comprises a "leaf spring" formed from a single piece of metal as shown. The exemplary preferred blade spring 112 includes a base portion 220, a curved flexing portion 222, a blade support portion 224 and an end portion 226. An exemplary preferred base portion 220 includes an aperture 228 with slots that form an "H" and a circular opening 230 centered at the crossbar of the "H". An exemplary preferred blade support portion 224 is formed with a blade slot 232 and complementary flanges 234 and 236 which are positioned on opposite sides of the blade slot 232. The complementary flanges 234 and 236 preferably, but do not necessarily, converge toward the end portion 226 of the blade spring 112.

An exemplary preferred blade slot 232 is formed as shown with a blade locking tab 237 and a blade stabilizing slot 238 which together provide a mechanism for securing or locking the blade 114 to the blade spring 112. More specifically, the blade locking tab 237 is sized to be fitted into a tab slot 115 (FIG. 1) of the blade 114. During assembly, the blade slot 232 is spread with a spreading tool and the blade 114 is inserted into the blade slot 232 with the blade locking tab 237 being fitted into the tab slot 115 and a tip portion of the blade 114 being fitted into the blade stabilizing slot 238. Thus, the blade 114 is secured or locked to the blade spring 112 without the need for any adhesive or glue. However, a conventional adhesive or glue (not shown) can additionally be applied along the blade slot 232 to further secure the blade 114 within the blade slot 232.

Referring to FIGS. 17–18C, an exemplary preferred safety spring 108 also comprises a "leaf spring" formed from a single piece of metal as shown. The exemplary preferred safety spring 108 includes a base portion 240, a curved flexing portion 242 and a coin roll guide portion 244. An exemplary preferred base portion 240 includes an aperture 246 with slots that form an "HI" and a circular opening 248 centered at the crossbar of the "H". An exemplary preferred guide portion 244 is formed with complementary guide edges 250 and 252 which are positioned on opposite sides of the guide portion 244 as shown.

Referring to FIGS. 6–11, the blade spring assembly 106 and the safety spring 108 are shown secured within the housing 102. Preferably, the blade spring assembly 106 is positioned closer to the bottom opening 118 of the housing 102 than the safety spring 108. Furthermore, in an exemplary preferred blade spring assembly 106, the end portion 226 is positioned no more than ⅛ inches away from the inside wall of the housing 102 that it faces.

In an exemplary preferred coin roll wrapper cutting apparatus 100, the blade spring assembly 106 and the safety spring 108 are secured to the front cover 104 and inserted through the first opening 142 and the second opening 144 of the housing 102, respectively. More specifically, the base portion 220 of the blade spring 112 is positioned adjacent the inside surface 180 of the front cover 104 as shown, with the first spring post 200 of the front cover 104 being fitted through the aperture 228 of the base portion 220. For additional stability, the base portion 220 is wedged into place against the ridges 204 and 206 of the front cover 104. The blade spring assembly 106 is oriented within the housing 102 such that the end portion 226 is positioned between the cutting blade 114 and the bottom opening 118. When the coin roll wrapper cutter apparatus 100 is assembled, the fins 164 and 172 of the housing 102 hold the base portion 220 of the blade spring 112 in position. In a similar fashion, the base portion 240 of the safety spring 108 is positioned adjacent the inside surface 180 of the front cover 104, with the second spring post 202 of the front cover 104 being fitted through the aperture 246 of the base portion 240. For additional stability, the base portion 240 is wedged into place against the ridges 208 and 210 of the front cover 104. When the coin roll wrapper cutter apparatus 100 is assembled, the fins 166 and 170 of the housing 102 hold the base portion 240 of the safety spring 108 in position.

The "leaf springs" described above (the safety spring 108 and the blade spring 112) allow the front cover 104 to be low profile resulting in a streamlined, compact coin roll wrapper cutting apparatus 100. It should be understood, however, that other types of springs can be employed for the safety spring 108 and/or the blade spring 112. Furthermore, mechanisms other than springs can be employed to perform the functions of the safety spring 108 and the blade spring 112.

In operation, the safety spring 108 functions as a "one-way valve mechanism" which allows a roll of coins to advance through the housing 102 from the top opening 116 to the bottom opening 118, but prevents the roll of coins from passing through the housing 102 from the bottom opening 118 to the top opening 116. Similarly, the blade spring 112 functions as a "one-way valve mechanism" by preventing a roll of coins entering through the bottom opening 118 from passing completely through the housing 102.

Figure 21:
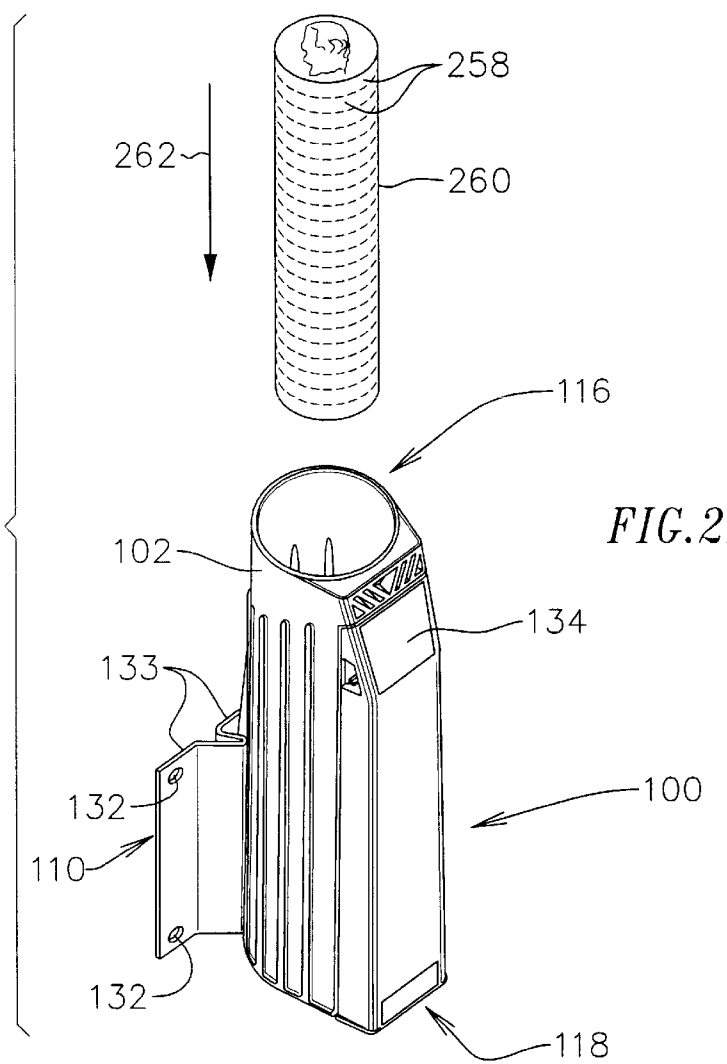
FIG. 21 is a perspective view of the apparatus of FIG. 1 shown with a roll of coins entering the housing through the top opening.

Referring to FIG. 21, a roll of coins 258 in a wrapper 260 is shown being advanced into the top opening 116 of the cutter apparatus 100 as indicated by the arrow 262. The wrapper 260 can be made of a variety of materials including, but not limited to, paper and plastic.

Figure 23:
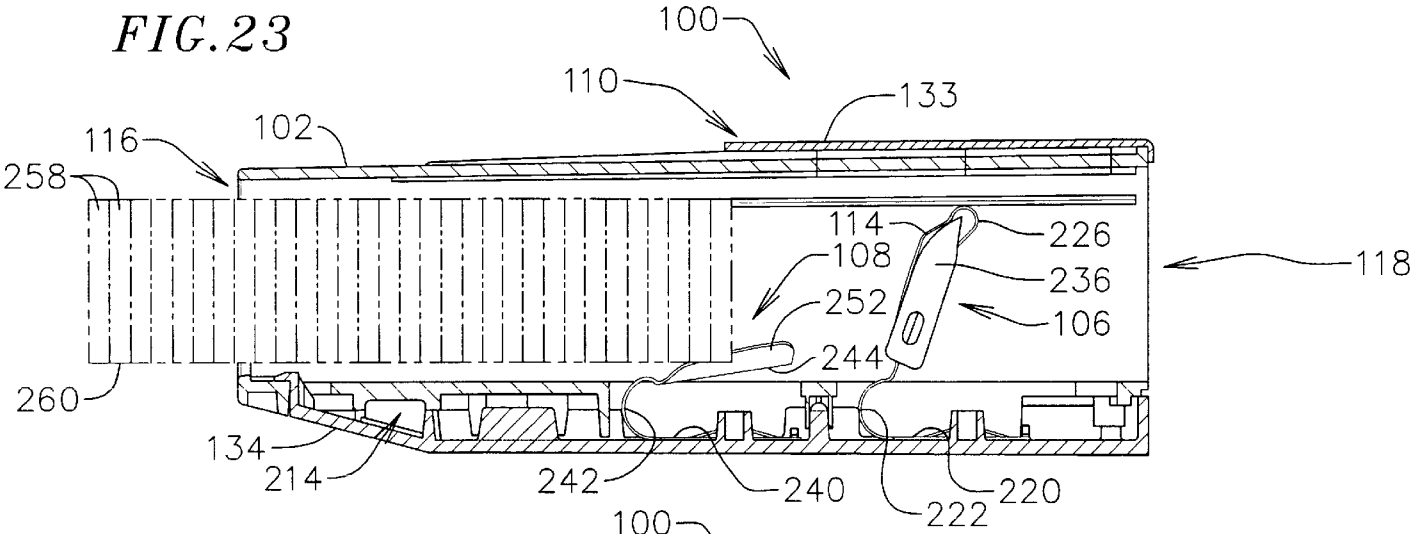
FIG. 23 is a cross-sectional side view of the apparatus of FIG. 1 shown with a roll of coins entering the housing and contacting the safety spring.

Referring to FIG. 23, the exemplary preferred safety spring 108 is positioned between the blade spring assembly 106 and the top opening 116. Thus, the safety spring 108 serves as a barrier to further lessen the chances that the user will be able to reach into the housing 102 through the top opening 116 and inadvertently contact the cutting blade 114.

Figure 24:
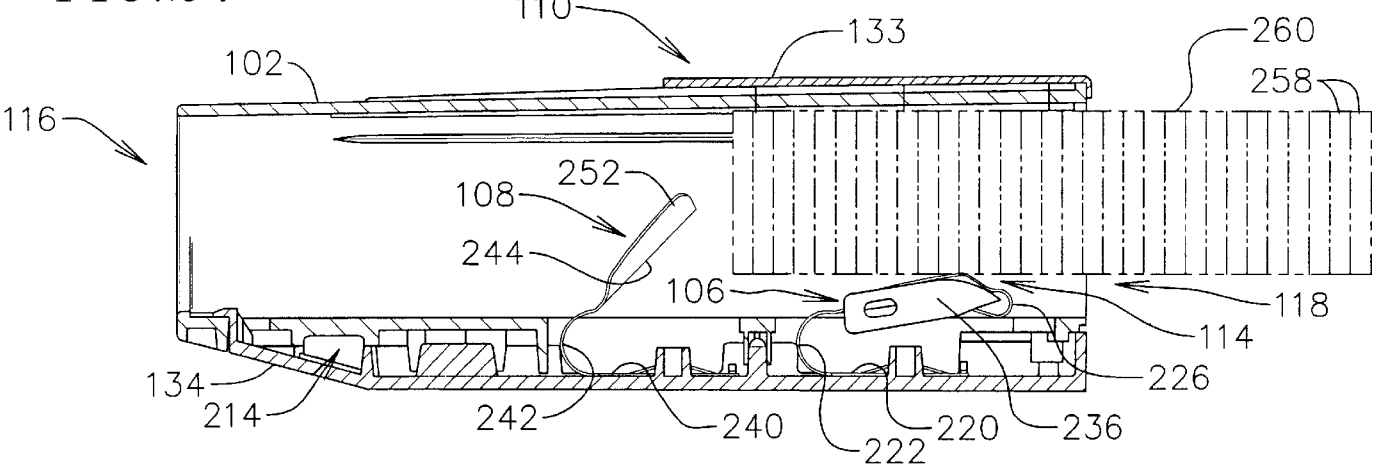
FIG. 24 is a cross-sectional side view of the apparatus of FIG. 1 shown with a roll of coins exiting the housing and contacting the blade spring assembly.

The guide portion 244 of the safety spring 108 pivots relative to the housing 102 when the roll of coins 258 enters the housing 102 through the top opening 116 and advances through the housing 102 to contact the guide portion 244. Referring to FIG. 24, the safety spring 108 springs back into place after the roll of coins 258 advances past it. If a cashier tries to reverse the direction of the roll of coins 258 at this point, the safety spring 108 prevents the roll of coins 258 from being pushed back out of the housing 102 through the top opening 116, thereby preventing a person from bringing their fingers into contact with the blade 114. Thus, the safety spring 108 functions as a one-way valve mechanism by preventing ill-advised attempts to reverse the direction of a roll of coins 258 after the roll of coins 258 has advanced past the safety spring 108.

The safety spring 108 also serves the function of centering the roll of coins 258 within the housing 102. More specifically, the guide portion 244 of the safety spring 108 is shaped, with its complementary guide edges 250 and 252, to contact and center the roll of coins 258 relative to the cutting blade 114.

Figure 22:
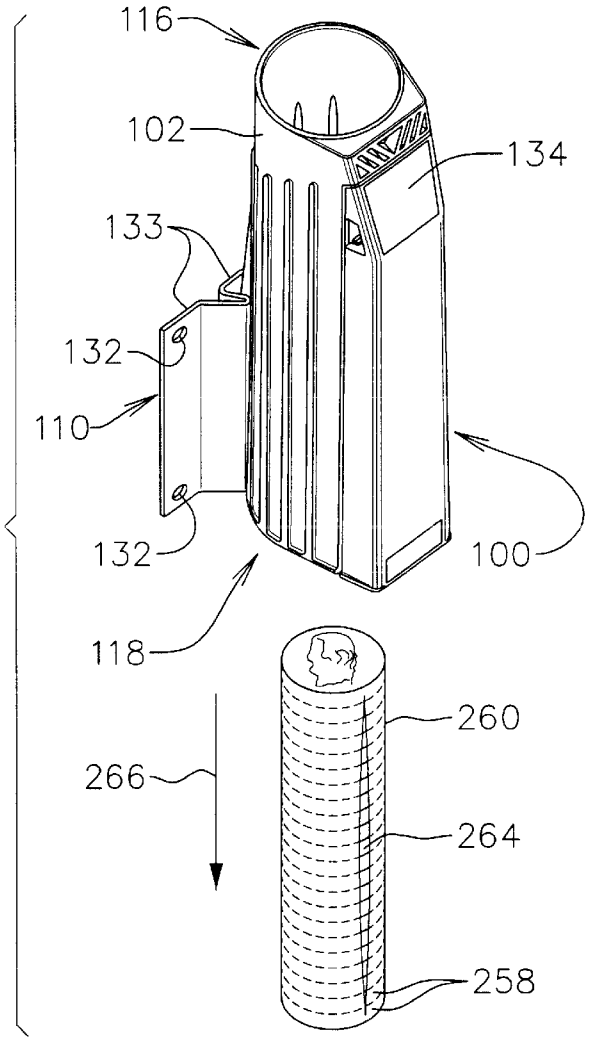
FIG. 22 is a perspective view of the apparatus of FIG. 1 shown with a roll of coins exiting the housing through the bottom opening.

Referring to FIGs. 22 and 24, the blade assembly 106 is secured within the housing 102 such that the cutting blade 114 makes a longitudinal cut 264 along the wrapper 260 as the roll of coins 258 is advanced through the housing 102, entering through the top opening 116 and exiting through the bottom opening 188 (as indicated by the arrow 266). In an exemplary preferred embodiment, the blade assembly 106 is position closer to the bottom opening 118 than the top opening 116, or sufficiently far away from the top opening 116 to significantly lessen the chances that a person will be able to reach into the housing 102 through the top opening 116 and bring their fingers into contact with the cutting blade 114.

The blade spring assembly 106 is also designed to prevent injuries when a person reaches into the housing 102 through the bottom opening 118. As discussed previously, the end portion 226 of the blade spring 112 is positioned between the cutting blade 114 and the bottom opening 118. This lessens the chances that a person will be able to reach into the housing 102 through the bottom opening 118 and bring their fingers into contact with the blade 114. Furthermore, the flexible nature of the blade spring 112 caused the blade spring 112 to move away from inserted fingers toward the top opening 116, thus further lessening the chances of contact with the blade 114.

The blade spring 112 also serves the function of centering the roll of coins 258 within the housing 102. More specifically, the blade support portion 224 is shaped, with its complementary flanges 234 and 236, to contact and center the roll of coins 258 relative to the cutting blade 114.

Although the present invention has been described in terms of the preferred embodiment above, numerous modifications and/or additions to the above-described preferred embodiment would be readily apparent to one skilled in the art. Thus, by way of example, and not of limitation, a blade fixed in position relative to the housing 102 can be employed (instead of the blade spring assembly 106) with the housing 102 being formed with guide members, fins, etc. for centering the roll of coins 258 relative to the fixed blade. It is intended that the scope of the present invention extend to all such modifications and/or additions.

We claim:

1. An apparatus for cutting a coin roll wrapper, the apparatus comprising:

a housing with a top opening and a bottom opening which are sized to receive a roll of coins in a wrapper; and a cutting assembly secured within the housing, the cutting assembly including a blade with a cutting edge, and a spring mechanically coupling the blade to the housing such that the cutting edge makes a longitudinal cut along the wrapper as the roll of coins is advanced through the housing, entering through the top opening and exiting through the bottom opening;

wherein the blade includes a tab slot;

wherein the spring is formed with a blade slot which defines a blade locking tab and a blade stabilizing slot;

wherein the blade is fitted into the blade stabilizing slot; and wherein the blade locking tab is fitted into the tab slot.

* * * * *